United States Patent [19]

Altemare

[11] 3,968,806

[45] July 13, 1976

[54] HAIR CLIP

[76] Inventor: Kenneth Altemare, 5247 Brownsville Road, Pittsburgh, Pa. 15236

[22] Filed: Feb. 12, 1975

[21] Appl. No.: 549,316

[52] U.S. Cl. ..... 132/48 R; 24/248 HC

[51] Int. Cl.[2] ..... A45D 8/24

[58] Field of Search ..... 132/46, 48 R, 48 A; 128/325–326, 346; 24/248 HC, 346, 354, 322

[56] References Cited

UNITED STATES PATENTS

| | | | |
|---|---|---|---|
| 2,201,719 | 5/1940 | Eicher | 132/46 A |
| 3,223,095 | 12/1965 | Seekings et al. | 132/46 A |
| 3,866,610 | 2/1975 | Kletschka | 128/346 |

*Primary Examiner*—G.E. McNeill

*Attorney, Agent, or Firm*—Stanley J. Price, Jr.; John M. Adams

[57] ABSTRACT

A hair clip is disclosed for use with hollow, thin-walled, tubular hair curlers. The hair clip has a clamping jaw portion at one end disposed at an obtuse angle to the body of the hair clip. At the other end from the clamping jaws, a pivot point permits the clip to be opened and closed by operating tabs that are formed on the clip near the pivot point. The clip is elongated and the clamping jaws, at one end of the clip, are at a distance from the pivot point, near the other end of the clip, which is greater than the diameter of the tubular hair curler. The clip may be easily set in place to hold the hair curler next to the scalp of the person utilizing the curler.

8 Claims, 3 Drawing Figures

HAIR CLIP

BACKGROUND OF THE INVENTION

This invention relates to a hair clip which is designed for use with hollow, thin-walled, tubular hair curlers. In modern day methods of hair grooming it has become acceptable to utilize relatively large diameter tubular hair curlers when setting women's hair. These hair curlers have the hair wound around them, and the hair is then clipped in place on the curler near the person's scalp. It has been customary to use various types of hairpins and hair clips for holding the tubular curlers in place.

In prior hair clips and hair curlers, it has been difficult to place the clips at the bottom of the curler near the scalp when several curlers are positioned in close proximity to each other on the head and the ends of the curlers abut each other. The hair clip of the present invention is designed with a portion that has clamping jaws that actually clip the hair and the tubular curler next to the woman's scalp. An elongated center portion of the hair clip functions to position the operating tabs of the hair clip at a distance from the clamping jaws so that the clip may be inserted down between adjacent curlers and operated by use of operating tabs without the necessity of the operator putting hands and fingers down next to the scalp on the tubular curler.

In the present invention, the clamping jaws of the hair clip are positioned at an obtuse angle to the elongated clip itself. The clamping jaws are preferably at an obtuse angle between 95° and 115° to the clip itself. The clip may be utilized in any hair setting procedure where the clips must be placed close to each other and clip the hair close to the scalp since the operating portion of the clip will be away from the scalp.

The hair clip of the present invention is spring loaded to the closed position so that the clamping jaws contact each other when the clip is completely closed. When the operating tabs are forced toward each other, the clip is open for placement.

Although the actual dimensions of the clip of the present invention may vary, the elongated portion of the hair clip is of such length that it is greater than the diameter of the tubular curler with which it is used.

SUMMARY

The present invention is directed to a hair clip which may be utilized with hollow, thin-walled, tubular hair curlers to clip the curlers close to the wearer's scalp in the setting of hair. The hair clip is such that it may be positioned in close working quarters where the hair curlers are next to each other on the wearer's head.

With the foregoing consideration in mind, it is an object of the present invention to provide an improved hair clip.

Another object of the present invention is to provide a hair clip which may be utilized to clamp hollow, thin-walled, tubular hair curlers in place when they are positioned in proximity to each other.

These and other objects of the present invention will become apparent as this description proceeds in conjunction with the accompanying drawings.

DESCRIPTION OF THE PREFERRED EMBODIMENT

Figure 2:
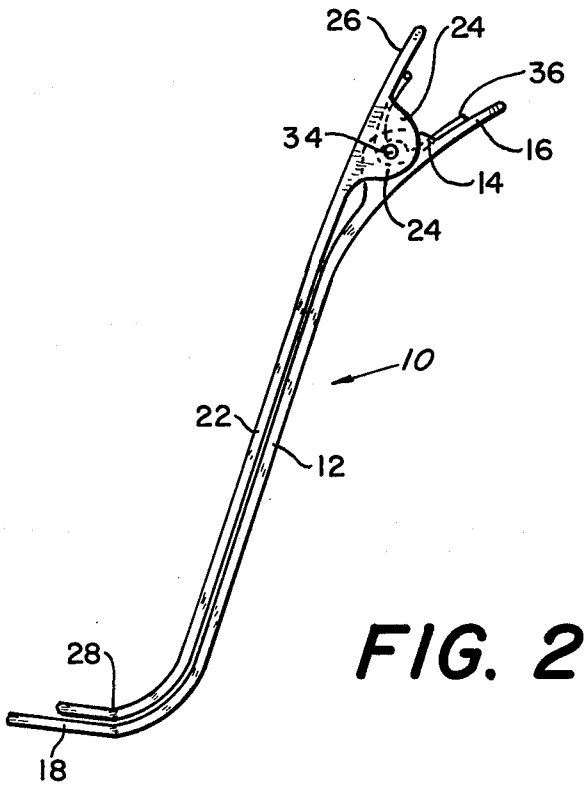
FIG. 2 is a side elevational view of the hair clip of FIG. 1.
Figure 1:
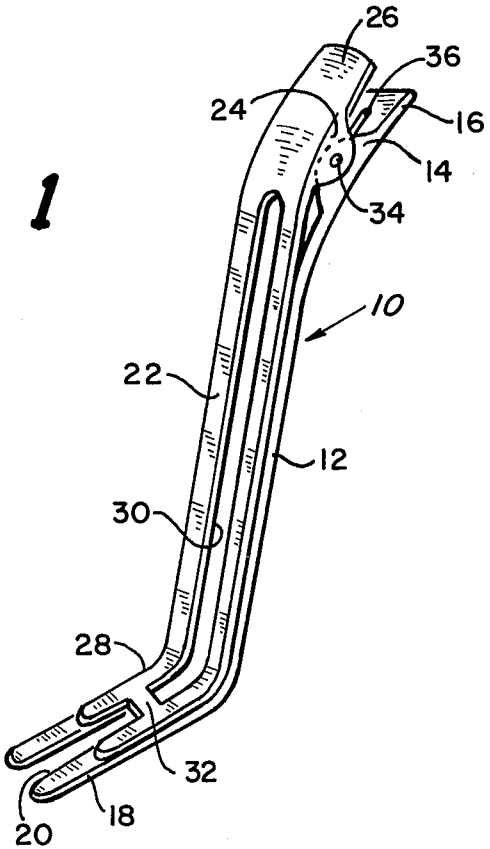
FIG. 1 is a perspective view of the hair clip of the present invention.

Referring to the drawings, and particularly FIGS. 1 and 2, there is shown a hair clip 10 which is formed with a base member 12. The base member has a pivot support mechanism 14 formed near one end thereof. Between the pivot support mechanism 14 and the proximate end of the base member 12, an operating tab 16 is formed. At the opposite end of base member 12 from operating tab 16, the base member has a clamping jaw portion 18 positioned at an obtuse angle to the main portion of base member 12. A slot 20 (FIG. 1) extends through the base member 12 from approximately the position of pivot support mechanism 14 throughout the entire length of base member 12 to the clamping jaw portion 18.

Cooperating with the base member 12 is a movable member 22 which has a pivot support mechanism 24 formed thereon. An operating tab 26 is formed between the pivot support mechanism 24 and the proximate end of movable member 22. A clamping jaw portion 28 is formed on movable member 22 at an obtuse angle thereto. A slot 30 (FIG. 1) extends through a substantial portion of the length of movable member 22.

A cross piece 32 formed in the clamping jaw portion 28 terminates slot 30 on movable member 22. It will be noted that the slot 20 on base member 12 extends through to the end of clamping jaw portion 18 of base member 12. It will also be noted that the clamping jaw portion 28 of movable member 22 is formed at substantially the same obtuse angle to movable member 22 that the clamping jaw portion 18 is to its base member 12. The clamping jaw portion 28 is shorter in length than the clamping jaw portion 18 but even clamping jaw portion 18 is less than one-third the length of base member 12.

The pivot support mechanisms 14 and 24 are connected by a pivot pin 34 so that base member 12 and movable member 22 rotate relative to each other about pivot pin 34.

A conventional coil spring 36 is arranged around pivot pin 34 and the ends of coil spring 36 extend against the operating tabs 16 and 26 of base member 12 and movable member 22, respectively, urging the operating tabs 16 and 26 away from each other so that clamping jaw portions 18 and 28 are spring loaded toward each other when the clip 10 is in the closed position.

Figure 3:
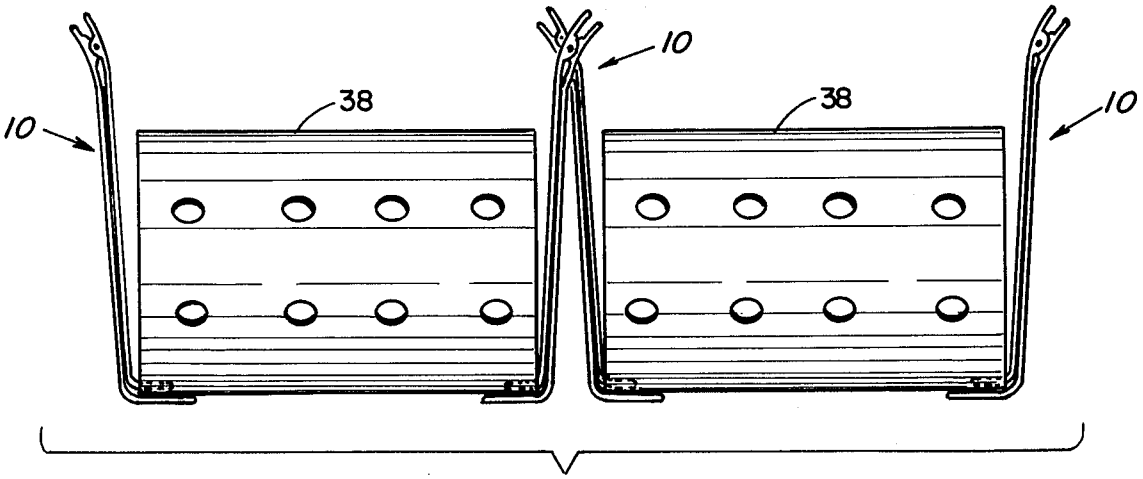
FIG. 3 is an elevational view of the hair clip of the present invention in use to clamp hair curlers.

As best seen in FIG. 3, the clips 10 are being utilized to clamp hollow, thin-walled, tubular curlers 38. It will be noted that in FIG. 3, the clamping jaw portions 18 and 28 of the respective clips 10 abut the bottom of the tubular curlers 38. It will further be noted that the pivot pin 34 and the operating tabs 16 and 26 of hair clips 10 are all above the tops of the curlers 38 so that the distance between the clamping jaw portions 18 and 28 and the pivot pin 34 are greater than the diameter of the thin-walled, tubular curlers 38.

In the preferred arrangement, the clamping jaw portions 16 and 28 are preferably disposed at an obtuse angle of from 95° to 115° to the respective base member 12 and movable member 22 of the clip 10. At an obtuse angle within that range, the hair clip may be easily inserted between curlers, and the clamping arrangment permits the curler to be secured near the scalp.

With the slot 20 in the base member 12 extending to the end of the clamping jaw portion 18, the bottom clamping jaw portion 18 may readily be inserted though hair below the curler adjacent to the scalp of the wearer. The cross piece 32 on the clamping jaw portion 28 prevents the top clamping jaw portion 28 from being inserted through the hair and tends to facilitate clamping when the clip is permitted to close. It will be seen that by having the operating tabs 16 and 26 extend diametrically beyond the curlers 38, the clips 10 may be operated without the operator having to place his fingers or hands down between the adjacent curlers 38.

The clip of the present invention is preferably formed from die-stamped, lightweight metal. It may also be formed from rigid plastic material.

It has been found that with the invention as described herein, the hair clip may rapidly be placed in position to hold hair curlers. This is especially advantageous to professional beauty operators who must place literally thousands of hair clips each day.

According to the provisions of the Patent Statutes, I have explained the principal, preferred construction, and mode of operation of my invention and have illustrated and described what I now consider to represent its best embodiment. However, I desire to have it understood that within the scope of the appended claims, the invention may be practiced otherwise than as specifically illustrated and described.

What is claimed is:

1. A hair clip for holding a hollow, thinwalled, tubular hair curler in position when setting hair comprising:

a. an elongated base member with a pivot support mechanism formed adjacent one end, an operating tab positioned on said base member between said pivot support member and said one end, and a clamping jaw portion positioned remotely of said operating tab at the other end and extending at an obtuse angle to said base member;

b. an elongated movable member with a pivot support mechanism formed adjacent one end, an operating tab positioned on said movable member between said pivot support member and said one end, and a clamping jaw portion positioned remotely of said operating tab at the other end and extending at an obtuse angle to said movable member such that said tubular hair curler is received between said base member clamping jaw portion and said movable member clamping jaw portion;

c. pivot means retained by said pivot support mechanisms for pivotally connecting said base member to said movable member in substantially spaced parallel, overlying relation with said operating tabs extending diametrically beyond the surface of said tubular hair curler to facilitate clamping of said clip thereto; and d. spring means positioned between said base member and said movable member around said pivot means for urging said members toward each to move said clamping jaw portions into abutting relation when said clip is closed and securely retain therebetween said tubular hair curler.

2. The hair clip of claim 1 wherein the distance between said pivot means and said clamping jaw portions is greater than the distance between said pivot means and said operating tabs such that said pivot means is displaced from the surface of said tubular hair curler.

3. The hair clip of claim 1 wherein said clamping jaw portions are formed at an obtuse angle of between 95° and 115° to said base member and said movable member.

4. The hair clip of claim 1 wherein said base member and said movable member are each formed with an elongated slot extending longitudinally through the length of said member, said elongated slots each having an upper portion positioned adjacent said pivot means and a lower portion positioned adjacent said clamping jaw portions and at an obtuse angle to said upper portion.

5. The hair clip of claim 1 wherein said clamping jaw portion on said base member is longer than said clamping jaw portion on said movable member and is positioned in substantailly spaced parallel, overlying relation therewith.

6. The hair clip of claim 4 wherein said base member slot extends angularly from adjacent said base member pivot support mechanism to the end of said base member clamping jaw.

7. The hair clip of claim 4 wherein said movable member clamping jaw has a cross connecting piece terminating said slot short of the end of said jaw.

8. The hair clip of claim 1 wherein said base member clamping jaw is less than one-third the length of said base member.

* * * * *